United States Patent [19]

Anne et al.

[11] Patent Number: 4,757,281

[45] Date of Patent: Jul. 12, 1988

[54] ROTARY MICROWAVE JOINT DEVICE

[75] Inventors: Jean-Claude Anne, Ponsan; Philippe Gourlain, Leguevin; Régis Lenormand, Toulouse; Gérard Raguenet, Labarthe Sur Leze, all of France

[73] Assignee: Alcatel Espace, Courbevoie, France

[21] Appl. No.: 41,253

[22] Filed: Apr. 22, 1987

[30] Foreign Application Priority Data

Apr. 28, 1986 [FR] France ..... 86 06127

[51] Int. Cl.[4] ..... H01P 5/22

[52] U.S. Cl. ..... 333/117; 333/135; 333/137; 333/21 A; 333/256; 333/261

[58] Field of Search ..... 333/256, 261, 257, 117, 333/136, 137, 239, 241, 242, 21 A, 135; 343/757, 760, 763

[56] References Cited

U.S. PATENT DOCUMENTS 3,668,567 6/1972 Rosen ..... 333/21 A
4,412,192 10/1983 Paolino ..... 333/257
4,700,154 10/1987 Schuegraf ..... 333/21 A X

FOREIGN PATENT DOCUMENTS 0045682 2/1982 European Pat. Off. .
0192186 8/1986 European Pat. Off. ..... 333/21 A
0196081 10/1986 European Pat. Off. ..... 333/21 A

*Primary Examiner*—Eugene R. Laroche
*Assistant Examiner*—Seung Ham
*Attorney, Agent, or Firm*—Sughrue, Mion, Zinn, Macpeak, and Seas

[57] ABSTRACT

The invention relates to a rotary microwave joint device comprising a main circular waveguide constituted by two portions (10, 11) situated as extensions to each other and rotatable relative to one another about their axis of symmetry, each of said two portions (10, 11) being provided with at least one access which is orthogonal thereto, and mechanical means enabling a circularly polarized wave to be obtained in the main waveguide. The invention is applicable to space telecommunications.

5 Claims, 3 Drawing Sheets

ROTARY MICROWAVE JOINT DEVICE

The invention relates to a rotary microwave joint device. In orbiting satellites, antennas for telecommunications via relay satellites must have very good pointing capabilities, typically:

$0 \leqq \sigma \leqq 120°$ (elevation)

$0 \leqq \phi \leqq 360°$ (azimuth).

BACKGROUND OF THE INVENTION

There are two types of installation for the electronic transmission and reception equipment:

in a first type the entire microwave transponder is situated behind the antenna; and in a second type intermediate frequencies are used to make it possible for only the power stages for microwave transmission, the low noise receivers, and the reception frequency converters to be installed immediately behind the antenna.

Temperature control of both types of installation is very difficult, and draws heavily on the satellite's power consumption budget.

In order to solve this problem, the invention makes it possible to integrate the electronic equipment for transmission and for reception of the platform of the satellite, by using a new rotary microwave joint device.

In general, rotary joint devices make use of the circularly symmetrical properties of coaxial or cylindrical modes of propagation. As a result, they require transitions to be provided between access guides (for inlets/-outlets) which operate with one type of propagation (rectangular guides, cylindrical guides) and the rotary joint itself.

Matching conditions restrict the utilization bandwidth to a ratio of not more than about 1.5. In, contrast, a coupler in accordance with the invention does not have such frequency limitations.

SUMMARY OF THE INVENTION

The present invention provides a rotary microwave joint device comprising a main circular waveguide constituted by two portions each situated in the extension of the other and rotatable relative to one another about their axis of symmetry, each of these two portions being provided with two mutually orthogonal accesses which are also orthogonal to the walls of the waveguide, and an inlet hybrid coupler having its two outlets coupled to the two accesses of the first portion via two waveguides, the device further including an outlet hybrid coupler having its two inlets coupled to the two accesses of the second portion of the main waveguide via two waveguides.

Advantageously, the two portions of the main waveguide have their outer ends as cutoff waveguides to constitute short circuit planes, the accesses being respectively situated in pairs in planes which are at predetermined distances from said short circuit planes.

In a variant embodiment, the invention provides a device in which lowpass filters are interposed between the hybrid couplers and the accesses to the two portions of the main waveguide, and level with said accesses, and wherein the two cutoff guides are disposed at opposite ends of the main waveguide, with each of said cutoff waveguides being provided with two accesses which are orthogonal thereto and which are orthogonal to each other, an inlet hybrid coupler having two outlets coupled to the accesses of the first one of said cutoff waveguides and an outlet hybrid coupler having its inlets coupled to the accesses of the second of said cutoff waveguides, the first and second cutoff waveguides coupled to the main waveguide being closed at their free ends.

In one particular embodiment, the invention provides a junction device provided, on either side of the junction, with:

a corrugated portion;

a corrugated/smooth transition; and a smooth portion.

BRIEF DESCRIPTION OF THE DRAWINGS

Embodiments of the invention are described, by way of example, with reference to the accompanying drawings, in which.

MORE DETAILED DESCRIPTION

Figure 1:
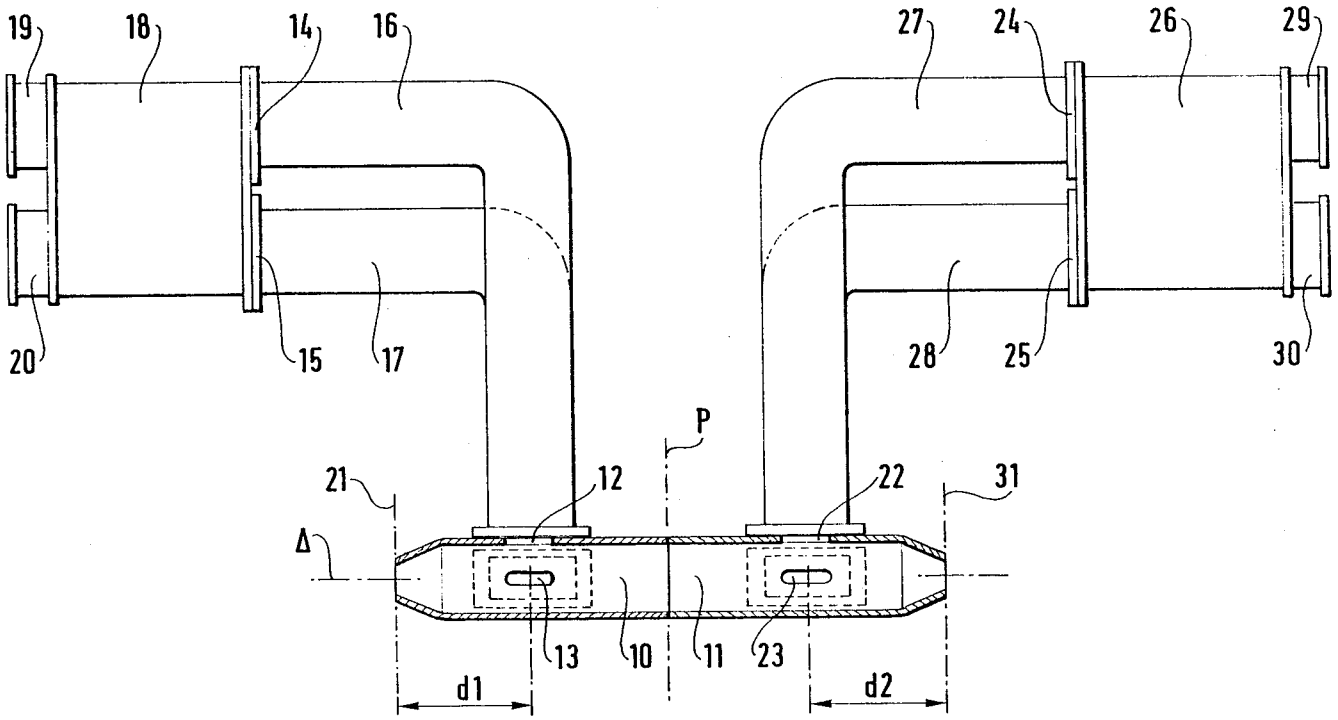
FIG. 1 is a diagrammatic side view of a device in accordance with the invention.

The device in accordance with the invention comprises a main circular waveguide constituted by two portions 10 and 11 each lying in the extension of the other and rotatable relative to the other about their axis of symmetry Δ.

Two accesses 12 and 13 to the first portion 10 of the main waveguide are orthogonal thereto and orthogonal to each other. They are coupled via two waveguides 16 and 17 to the outlets 14 and 15 of a first hybrid coupler 18 having a coupling coefficient of 3 dB. The inlets to the coupler 18 are connected to two waveguides 19 and 20.

These two accesses 12 and 13 are situated at a distance d1 from a short circuit plane 21 provided by a cutoff waveguide.

Two accesses 22 and 23 to the second portion 11 of the main waveguide are orthogonal thereto and orthogonal to each other. They are connected via two waveguides 27 and 28 to the inlets 24 and 25 of a second hybrid coupler 26 having a coupling coefficient of 3 dB. The outlets from the coupler 26 are connected to two waveguides 29 and 30.

These two accesses 22 and 23 are situated at a distance d2 from a short circuit plane 31 provided by a cutoff waveguide.

The short circuit plane 21 is situated at a distance d1 from the two accesses 12 and 13 so that all of the energy propagates along the main waveguide from the first portion 10 towards the second portion 11. In contrast, the short circuit 31 is situated at a distance d2 from the two slots 22 and 23 so that all of the energy from the slots 12 and 13 propagates along the waveguides 27 and 28.

At the junction plane P, electrical continuity is provided in conventional manner by mechanical contact between the facing ends of the portions 10 and 11 of the main conductor.

The waveguides providing the junction between the hybrid couplers (18, 26) and the main waveguides (10, 11) are rectangular waveguides.

The inlet 19 of the two inlets to the hybrid coupler 18 receives a signal which is transmitted to both of the waveguides 16 and 17 and which serves to transmit a circularly polarized wave into the main waveguide via the two accesses 12 and 13 providing coupling therewith.

Figure 2:
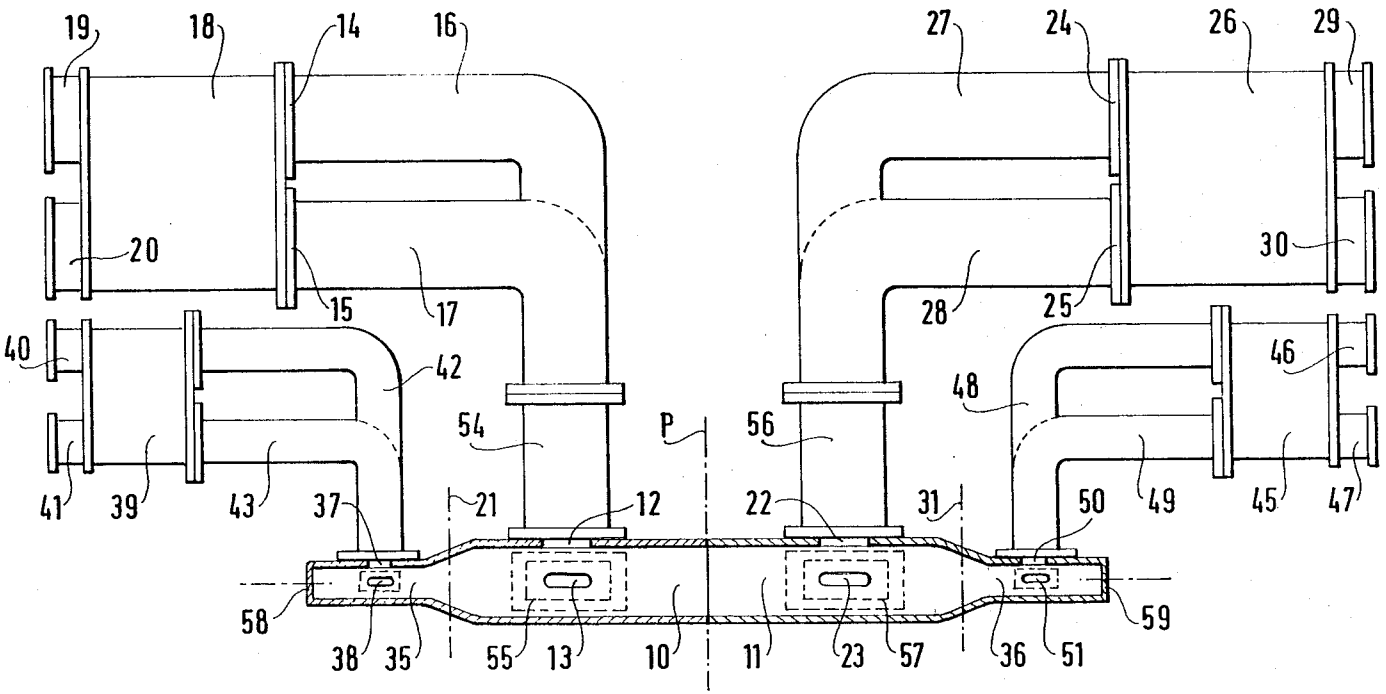
FIG. 2 is a diagrammatic side view of a variant device in accordance with the invention.

In a variant embodiment of the invention shown in FIG. 2, use is made of the two cutoff waveguides 35 and 36 disposed at opposite ends of the main waveguide (10, 11) as shown in FIG. 1.

In similar manner to the device shown in FIG. 1, two accesses 37 and 38 to the waveguide 35 are orthogonal thereto and orthogonal to each other.

A hybrid coupler 39 has its inlets connected to two waveguides 40 and 41 and has two outlets connected to two waveguides 42 and 43 which are coupled to said two accesses 37 and 38.

Similarly, a hybrid coupler 45 having its outlets connected to two waveguides 46 and 47 has its two inlets connected to two waveguides 48 and 49 which are coupled to two accesses 50 and 51 to the waveguide 36, said two accesses being orthogonal to the waveguide 36 and orthogonal to each other.

The two cutoff waveguides 35 and 36 have their free ends 58 and 59 closed and situated at a distance from the access planes (37, 38, and 50, 51) such that all of the energy is transmitted firstly from the coupler 39 via the accesses 37 and 38 towards the junction and then from the junction towards the coupler 45 via the accesses 50 and 51.

This circularly polarized wave of the main waveguide (10, 11) is excited without any obstacle in said main waveguide. As a result, if four filters (54, 55, and 56, 57) of the lowpass type are placed to put short circuit planes in the access planes (12, 13 and 22, 23), the device may be used for another frequency band capable of propagating in a waveguide diameter which is smaller than the diameter in the imaginary short circuit planes 21 and 31 which are obtained by the cutoff waveguides. For use at higher frequencies, the diameters of the waveguides 35 and 36 are therefore less than the diameter of the cutoff waveguide.

If the lowpass filters 54 and 55 have short circuit planes in the access planes 12 and 13, it becomes possible to operate using a second frequency band.

The operation of a device in accordance with the invention and with the variant thereof is described above solely with respect to using one inlet to each of the inlet hybrid couplers (18, 39) and the corresponding single outlet from each of the outlet hybrid couplers (26, 45).

However, the second inlet to each hybrid coupler may be used to convey a second signal at the same frequency as the signal conveyed by its first inlet.

Figure 3:
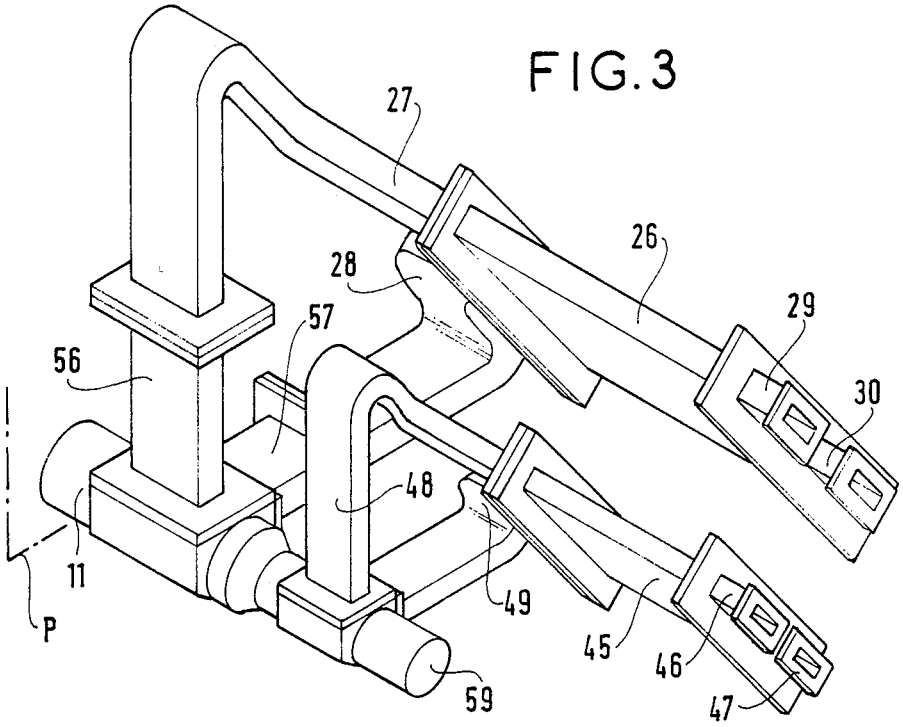
FIG. 3 is a fragmentary perspective view of the FIG. 2 device.

Thus, using the coupler device shown in FIG. 1, two same-frequency channels may be conveyed, and using the coupler device shown in FIGS. 2 and 3, two first frequency channels and two second frequency channels may be conveyed.

Figure 4:
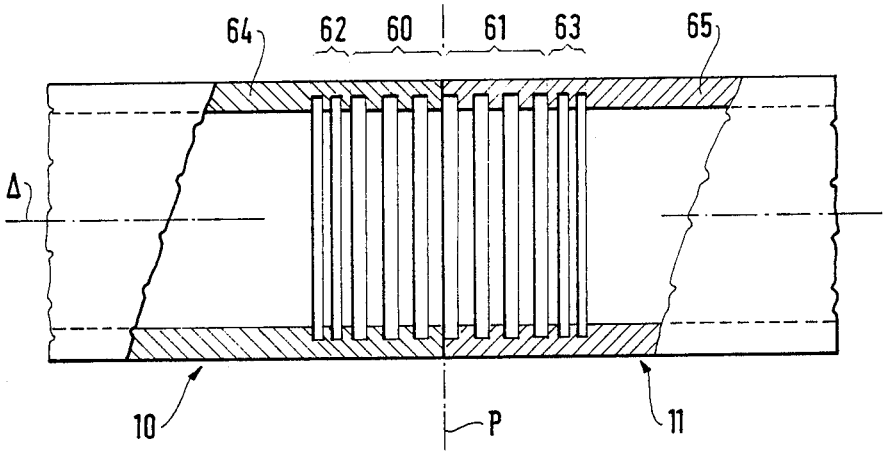
FIG. 4 is a fragmentary section through a variant device in accordance with the invention.

The electrical contact between the two portions 10 and 11 of the central conductor may be provided by means of a coupling device shown in FIG. 4.

This coupling device comprises three portions on opposite sides of the coupling plane P:

a corrugated portion (60, 61);

a corrugated/smooth transition (62, 63); and a smooth portion (64, 65).

The electrical connection in the plane P takes place at the bottom of a corrugation.

This type of connection provides good electrical continuity without requiring very good mechanical contact.

Naturally, the present invention has only been described and shown by way of preferred examples and its component parts could be replaced by other equivalent parts without going beyond the scope of the invention. Thus, it is possible to offset the pairs of accesses which are coupled to the same waveguide by $\lambda g/2$ where $\lambda g$ is the length of the wave guided in said waveguide, thereby obtaining better decoupling performance between said two accesses.

It is also possible, in the coupler device shown in FIG. 1, to obtain a circularly polarized wave while using only one of the accesses 12 or 13 and placing a polarizing obstacle in the first portion 10 of the main waveguide.

Similarly, said circularly polarized wave may be extracted by using only one of the accesses 22 or 23 after placing a polarizing device in the second portion 11 of the main waveguide.

When operating with polarizers, it is immediately obvious to extend the possibilities to two frequency accesses by using both of the accesses 12 and 13 and both of the accesses 22 and 23 simultaneously.

It is possible to generalize the transmission of twice two channels at two different frequencies provided by the device shown in FIG. 2 to n times two channels at n different frequencies, by providing n connections of the same type as those (10, 35 and 11, 36) shown in FIG. 2 at the free ends of the central waveguide.

We claim:

1. A rotary microwave joint device comprising a main circular waveguide constituted by two portions each situated in the extension of the other and rotatable relative to one another about their axis of symmetry, each of these two portions being provided with two mutually orthogonal accesses which are also orthogonal to the walls of the waveguide, and an inlet hybrid coupler having its two outlets coupled to the two accesses of the first portion via two waveguides, the device further including an outlet hybrid coupler having its two inlets coupled to the two accesses of the second portion of the main waveguide via two waveguides.

2. A device according to claim 1, wherein the two portions of the main waveguide have their outer ends as cutoff waveguides to constitute short circuit planes, the accesses being respectively situated in pairs in planes which are at predetermined distances from said short circuit planes.

3. A device according to claim 2, wherein lowpass filters are interposed between the hybrid couplers and the accesses to the two portions of the main waveguide, and level with said accesses, and wherein the two cutoff guides are disposed at opposite ends of the main waveguide, with each of said cutoff waveguides being provided with two accesses which are orthogonal thereto and which are orthogonal to each other, an inlet hybrid coupler having two outlets coupled to the accesses of the first one of said cutoff waveguides and an outlet hybrid coupler having its inlets coupled to the accesses of the second of said cutoff waveguides.

4. A device according to claim 3, wherein the first and second cutoff waveguides coupled to the main waveguide are closed at their free ends.

5. A device according to claim 1, further including a coupling device comprising, on either side of a junction plane P and defined in order, axially away from said junction plane P by said two portions of said main circular wave guide:

an internal corrugated portion;

an axially aligned, internal corrugated/smooth transition; and an axially aligned, internal smooth portion.

* * * * *